United States Patent [19]

Stanich et al.

[11] Patent Number: 4,803,904

[45] Date of Patent: Feb. 14, 1989

[54] EXTENSION DEVICE FOR POWER SCREWDRIVER

[76] Inventors: Louis Stanich, 34 McNicoll Ave., Willowdale, Ontario, Canada, M2H 2A8; Henry D. Sweeny, 152 Stoneybrook Drive, Kitchener, Ontario, Canada, N2M 4L7

[21] Appl. No.: 199,295

[22] Filed: May 26, 1988

Related U.S. Application Data

[63] Continuation-in-part of Ser. No. 888,303, Jul. 22, 1986, Pat. No. 4,766,783.

[51] Int. Cl.[4] ..... B25B 21/00

[52] U.S. Cl. ..... 81/54; 81/177.2

[58] Field of Search ..... 81/54, 180.1, 57.11–57.14, 81/436, 467, 469, 177.1, 177.2; 408/226, 705

[56] References Cited

U.S. PATENT DOCUMENTS 3,822,960 7/1974 Degen ..... 408/226

4,030,383 6/1977 Wagner ..... 81/54

FOREIGN PATENT DOCUMENTS 2129353 5/1984 United Kingdom ..... 81/54

*Primary Examiner*—Debra Meislin

*Attorney, Agent, or Firm*—Jones, Tullar & Cooper

[57] ABSTRACT

A device is provided for increasing the distance between the power head and bit of a power screwdriver, particularly one intended for driving drywall screws. The device includes a polygonal drive rod which replaces the original drive rod in the tool's clutch mechanism, a cylindrical sleeve which is provided at the free end of the new drive rod and receives the original drive rod at the other end thereof, and a cylindrical adaptor which receives the sleeve internally and connects the power head to the depth gauge of the tool, the bit still projecting from the depth gauge. Any number of the extension sets can be interconnected together to increase the extension length as desired. With the extension in use drywall screws can be driven in areas previously not accessible due to interference with the power head, and the operator can drive screws in ceilings while standing on the floor rather than on scaffolding and subfloors could also be screwed down without the operator requiring to kneel or stoop.

12 Claims, 5 Drawing Sheets

EXTENSION DEVICE FOR POWER SCREWDRIVER

CROSS REFERENCE TO RELATED APPLICATION

This is a continuation-in-part of our copending U.S. patent application Ser. No. 888,303 filed July 22, 1986, now U.S. Pat. No. 4,766,783.

FIELD OF THE INVENTION

The present invention relates generally to an accessory for use with a power tool such as a power drill or screwdriver and particularly to a device for extending the distance between a power tool and a bit for driving drywall screws into a receiving medium.

BACKGROUND AND SUMMARY OF THE INVENTION

There presently exist power tools specifically designed for driving drywall screws through a drywall panel into a receiving medium, such as a wooden stud, for securing the panel to the stud. The tool typically has a bit adapted to mate with the head of the screw, a depth gauge, a chuck for holding the bit, a clutch mechanism and a power unit. Normally the screw will be driven until the head is slightly below the surface of the panel, creating a "dimple" above the head which can be filled with drywall compound to hide the head from view. The clutch is usually preset to overrun at a specific torque and the torque is predetermined to be that required to drive the screw to the correct depth. When the clutch overruns, the operator knows that the screw has been driven properly.

In the majority of situations there is adequate clearance around the screws so that a power tool can be used in close proximity to the panel itself. There are other situations, however, where it is impossible to position the tool close to the panel and in such instances it becomes necessary to drive screws bY hand or to use drywall nails. Such a situation can exist, for example, where there is ductwork near a ceiling and an adjacent wall, making it impossible to drive screws into a wooden header of the adjacent wall.

Also, when driving screws into ceiling panels in most rooms the operator has to stand on a scaffold or use stilts to position his body close enough to the ceiling to drive the screws.

The present invention has been designed to overcome the problem of driving screws, particularly drywall screws, in hard-to-reach areas and from the floor to the ceiling. The invention provides an exeension which generallY can fit between the power head and the depth gauge or bit of a drywall "gun" as described above, thereby increasing the distance between the bit and the power head. This permits positioning of the bit in areas otherwise too small to accept the power head and also permits an operator to drive ceiling screws while standing on the floor. The extension device is provided as a plurality of sets of discrete elements so that any number of sets can be combined together to achieve the desired length of extension.

In one particular embodiment for one popular type of drywall gun the basic set includes a hexagonal drive rod receivable in the chuck of the tool in place of the original drive rod, a cylindrical sleeve having a hexagonal bore therethrough for receiving the replacement drive rod at one end and the original drive rod at the other end, and a cylindrical adaptor receiving the sleeve therein and bridging the gap between the chuck and the depth gauge of the tool. Since the depth gauge is normally threaded to the power head the adaptor will have a female thread at one end for attachment to the power head and a male thread at the other end for attachment to the depth gauge. If a further extension is required another basic set could be attached to the outer end of the first set and the depth gauge attached thereto rather than to the first set.

In another embodiment the replacement drive rod and the sleeve could be incorporated into a single molded piece having a sleeve portion, a hexagonal projection at one end and a hexagonal bore at the other end. The projection of one sleeve portion would be matable with the hexagonal bore of an adjacent sleeve portion when multiple extensions are used.

DESCRIPTION OF THE PREFERRED EMBODIMENT

Figure 1:
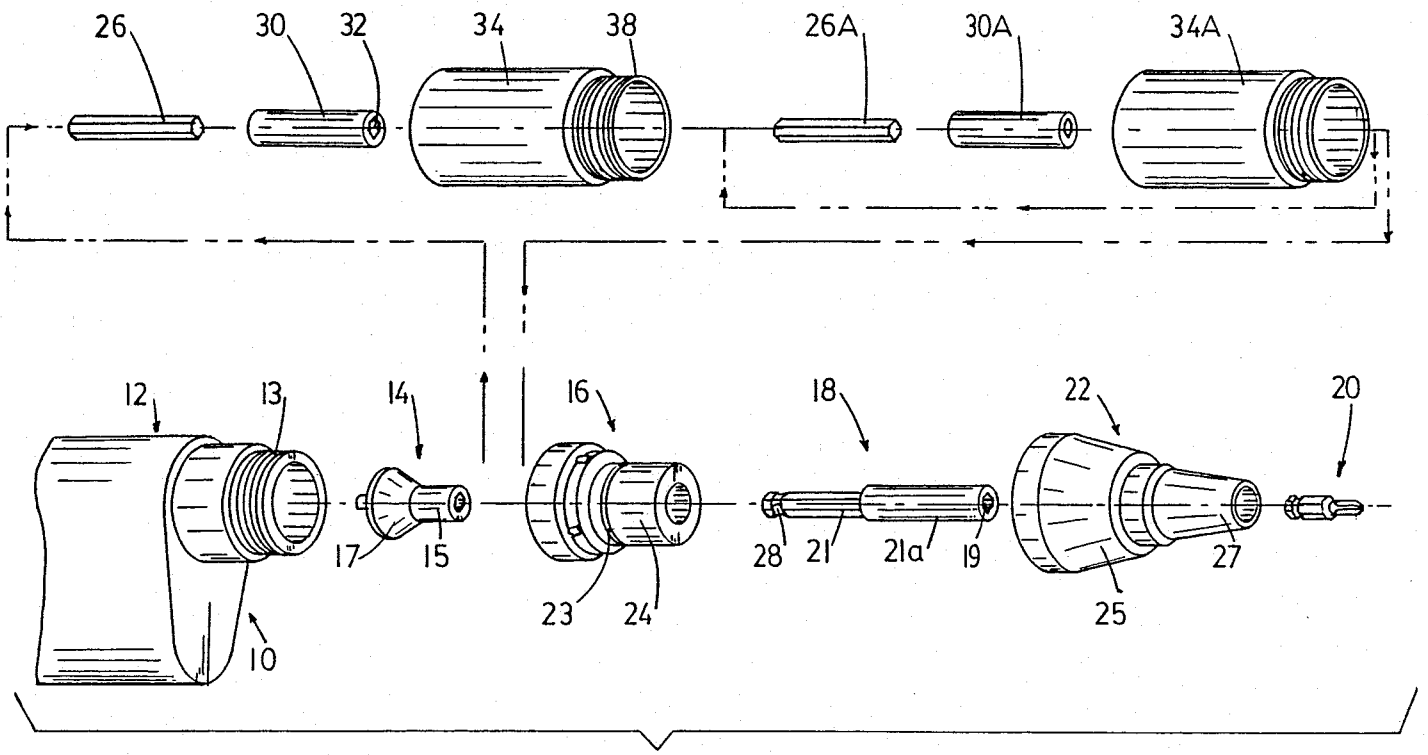
FIG. 1 shows in exploded view the components of the present invention and their relationship to a commercially available power tool.

The lower half of FIG. 1 shows, in exploded view, the usual components of a typical commercially available power tool (as made by Black & Decker Inc.) for driving drywall screws into a receiving medium. The tool 10 includes a power head 12 containing an electric motor, a clutch 14 receivable in the power head and including a chuck portion 15. A clutch cover 16 is threadably received on threads 13 of power head 12 and includes a bushing portion 24 over which depth gauge 22 normally slides. The chuck portion 15 receives internally a drive rod 18 which in turn has a hexagonal rod portion 21 and a magnetized bit holder **21*a* with a hexagonal recess 19 at its end for receiving a drive bit 20. Depth gauge 22 is attached by way of a snap ring 23 to hold and properly support and center the drive bit, and to set the depth of "dimple" for the screw by relative rotation of the inner and outer portions 25, 27** thereof.

The upper half of FIG. 1 illustrates two sets of the extension device of the present invention, it being understood that any number of sets can be assembled together to achieve the desired length of extension.

Each set is made up of three components, each being about the same length, say about 2 inches. First of all there is a hexagonal drive rod 26 which is adapted to be received in the chuck portion 15. The drive rod 26 of the basic set can have a circumferential groove 28 (as is shown on rod portion 21) at one end for reception of a locking detent within the chuck portion. The next component of the invention is a cylindrical sleeve 30 having a hexagonal through bore 32 adapted to receive the rod 26 in a press fit therewith. Sleeve 30 is preferably molded from a polymeric plastic material such as ZYTEL ST (trade mark). The last component of the invention is a cylindrical external adaptor 34. At one end the adaptor has an internal female thread 36 for threaded attachment to the power head threads 13 and at the other end the adaptor has an external male thread 38 for mating with the internal female thread (not shown) of the clutch cover 16. The adaptor 34 is preferably molded from a strong hard plastic material such as ZYTEL ST.

Figure 4:
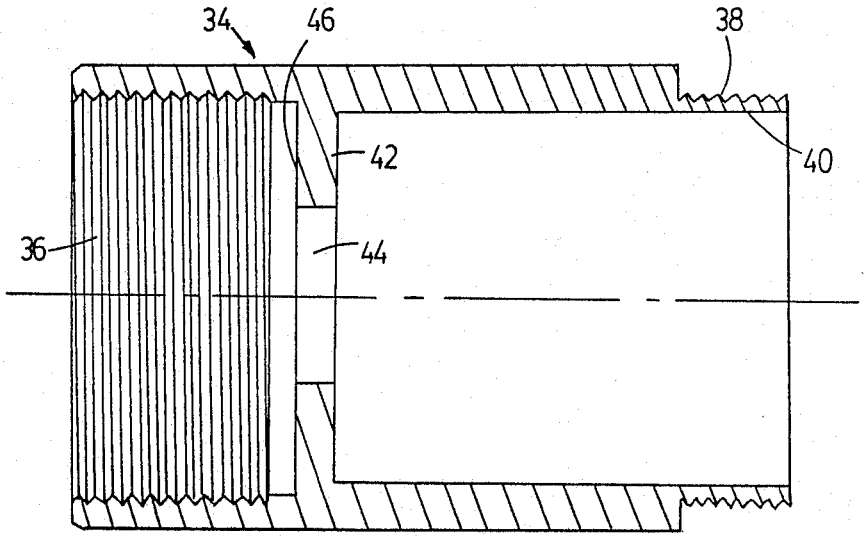
FIG. 4 shows an enlarged longitudinal cross-section of a typical adaptor member.

As seen in FIG. 4 the adaptor 34 has a large diameter bore 40 therein which is interrupted by a transverse wall 42 near the internal threads 36. Wall 42 has a central hole 44 therethrough slightly larger in diameter than the sleeve 30. The surface 46 of the wall 42 facing the threads 36 is intended to bear against the conical surface 17 of the clutch 14 to help center the clutch and to hold it in driving engagement with the power head 12. Hole 44 is also of a size to permit the chuck portion 15 to pass therethrough.

In order to use the basic set of this invention the operator first of all disconnects the depth gauge 22 from the clutch cover 16 by pulling it off the snap ring 23. He then pulls the rod portion 21 from the chuck portion 15 and removes the clutch cover 16 from the power head 12, exposing the clutch 14. The clutch 14 is then inserted into left hand end of an adaptor 34 so that the chuck portion 15 passes through opening 44 in transverse wall 42. The adaptor 34 is then assembled to the power head with threads 36 engaging threads 13 and the clutch 14 captures in its usual position. One end of an extension rod 26 is pushed into the chuck portion 15 and a sleeve 30 is press fit over the free end of the rod 26, the sleeve 30 being pushed on until the end face of rod 26 is essentially at the mid point of the sleeve.

Reassembly is completed by threading the clutch cover 16 onto the threads 38 of adaptor 34, inserting the rod portion 21 of the drive rod 18 into the open end 32 of sleeve 30 until it abuts the end of rod 36 within sleeve 30, inserting the bit 20 into the end 19 of the bit holder **21*a* and pressing the depth gauge 22 onto the clutch cover 16 over the snap ring 23. By adding the basic set to the power tool 10 the distance between the bit 20 and the power head 12** has been increased by the length of the set and the operator has more maneuverability with respect to the driving of screws.

If a further extension is required another set or sets of drive rod, sleeve and adaptor can be connected in series to the basic set. The drawing shows one additional set comprising a drive rod 26A, a sleeve 30A and an adaptor 34A which can be connected to the basic set in the same manner as the basic set is connected to the power tool 10. The drive rod 26A would interconnect the sleeves 30 and 30A and the rod 21 of drive rod 18 would then be connected to the sleeve 30A rather than to the sleeve 30. Adaptor 34A would interconnect adaptor 30 and the clutch cover 16.

Drive rod 26A need not have a circumferential groove such as 28 therein, thereby simplifying the manufacturing process, although operation of the invention would not be affected if it did have such a groove.

Figure 2:
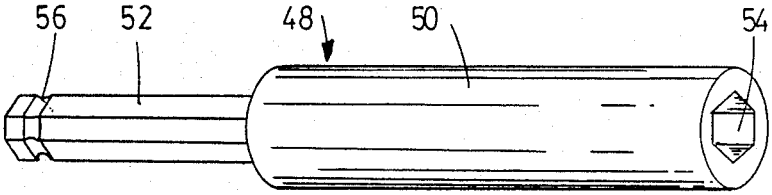
FIG. 2 shows an enlarged view of a one-piece sleeve and rod device for use in another embodiment of the invention.

FIG. 2 shows an alternative to the embodiment as described hereinabove. In FIG. 2 there is illustrated a one-piece unit 48 which has a sleeve portion 50 and a hexagonal extension 52 integrally formed therewith at one end. At the other end the sleeve has a blind hexagonal bore 54 therein. This unit replaces the individual rods 26 and sleeves 30 of the first embodiment. It is clear that with the second embodiment the extension 52 is receivable in the chuck portion 15 of the tool and that either the hexagonal portion 21 of the drive rod 18 or another extension 52 is receivable in the blind bore 54. Adaptors 34 as previously described would still be used between the power head 12 and the clutch cover 16. The unit 48 could be advantageously molded from an engineering plastic material. If desired the extension 52 can have a circumferential groove 56 for reception of a locking spring or detent in the chuck portion 15 of the tool.

Figure 3:
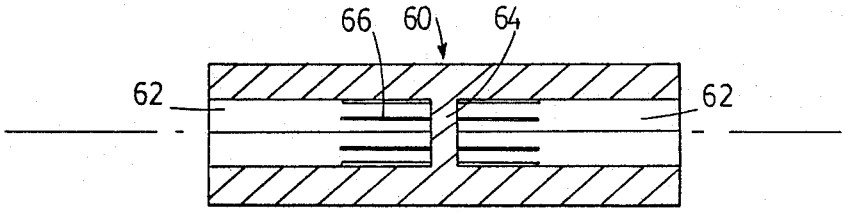
FIG. 3 shows an enlarged longitudinal cross-section of a preferred sleeve configuration.

In the preferred embodiment a rod 26 having a groove 28 is receivable in a sleeve 60 as depicted in FIG. 3. Sleeve 60 is molded from a material such as ZYTEL ST and has a blind hexagonal bore 62 extending inwardly rom each end to a central wall 64. Narrow ribs 66 on the walls of the bores adjacent the wall 64 tightly grip the extension rod, preferably made of aluminum, to achieve an extension member having the same outwards appearance as member 48 (FIG. 2). One of the bores 62 will receive an extension rod 26 to create the extension member whereas the other bore 62 is able to receive the rod 21 of drive rod 18, or another extension rod 26.

The present invention has been described with respect to a specific commercially available drywall "gun" and hence the means such as threads 13, 36 for connecting the adaptor to the "gun" were designed for use with that tool. The principles of the invention are applicable to other commercially available drywall guns even though specific structural changes might be necessary to achieve proper torque transmission from the power head to the bit. Essentially the cross-section of the drive rods 26, 26A and the bores 32, 54, 62 of the sleeves 30, 30A, 50 or 60 should be polygonal and match that of the drive rod 18. Furthermore, the extension device of the invention may not fit between the chuck and clutch cover of each available power tool. It might be necessary, for example, to fit the extension between the power head and the depth gauge if the design of the tool makes t difficult to disconnect the depth gauge from the clutch cover or if a clutch cover per se is not provided. FIGS. 5 to 8 show schematically how extension devices according to the present invention might be produced for and used with power screwdrivers sold under the trade marks MAKITA, RYOBI and MILWAUKEE. As indicated above, there may be specific structural changes required to accommodate the particular power tool and the assembly steps may differ somewhat. However, principles of the invention remain the same.

Figure 5:
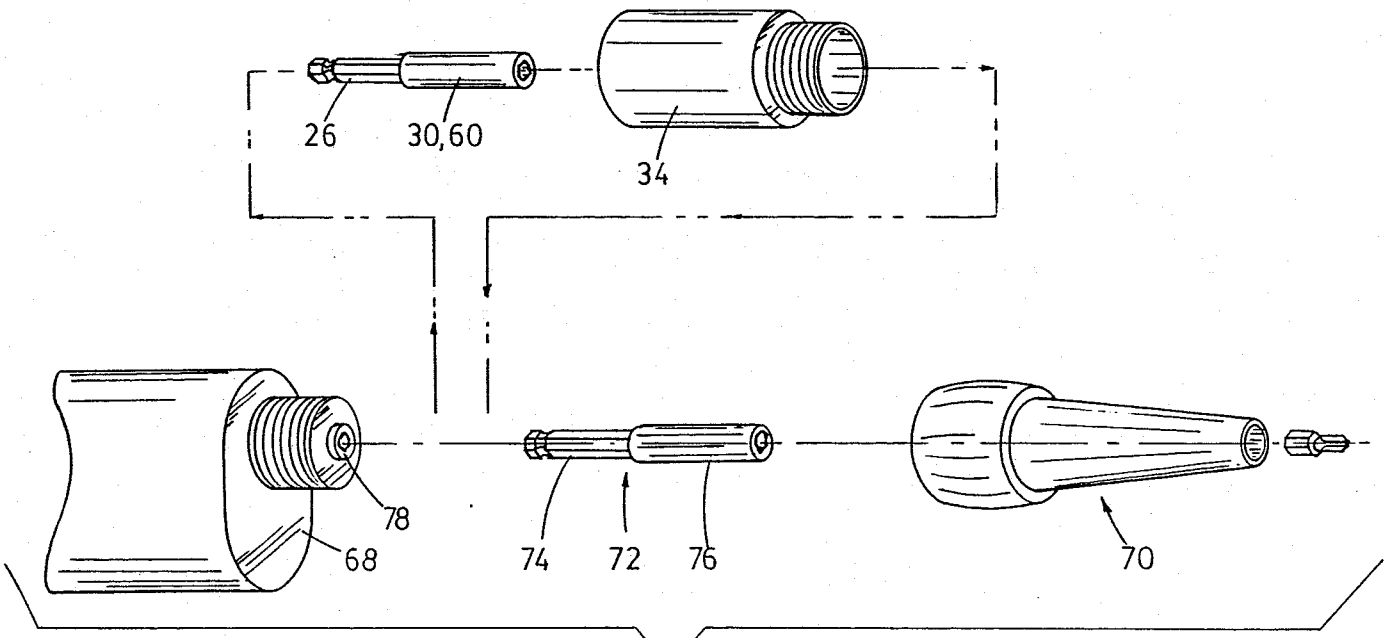
FIGS. 5 to 8 show embodiments of the present invention particularly useful with different makes of power tools.

FIG. 5 illustrates the assembly of an extension device to a typical MILWAUKEE power screwdriver. In such a tool the clutch is encased in the gun and does not have to be removed or moved. In this embodiment the nose cone and depth gauge assembly 70 is unthreaded from the power head 68, the drive rod 72 having a rod portion 74 and a bit holder 76 is removed from the clutch 78 and the appropriate extension comprising extension rod 26, sleeve 30 (or 60) and adaptor 34 is attached to the power head, essentially as previously described. The nose cone and depth gauge assembly 70 is threaded to the free end of adaptor 34 with the drive rod 72 inserted into the extension sleeve 30 (or 60). The tool is ready for use. Of course, any number of extension sets could be used to obtain the desired length of extension.

Figure 6:
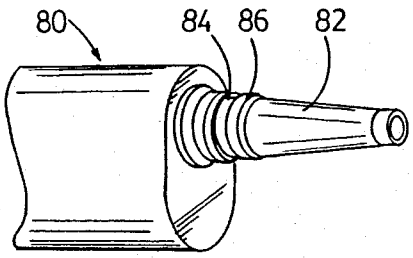
Figure 7:
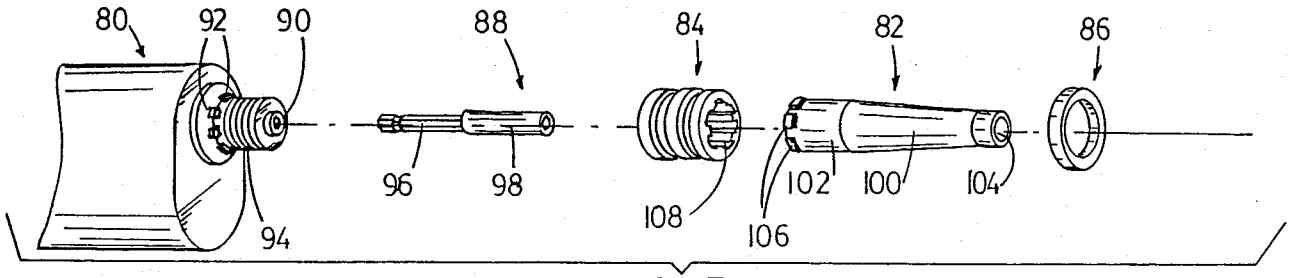
Figure 8:
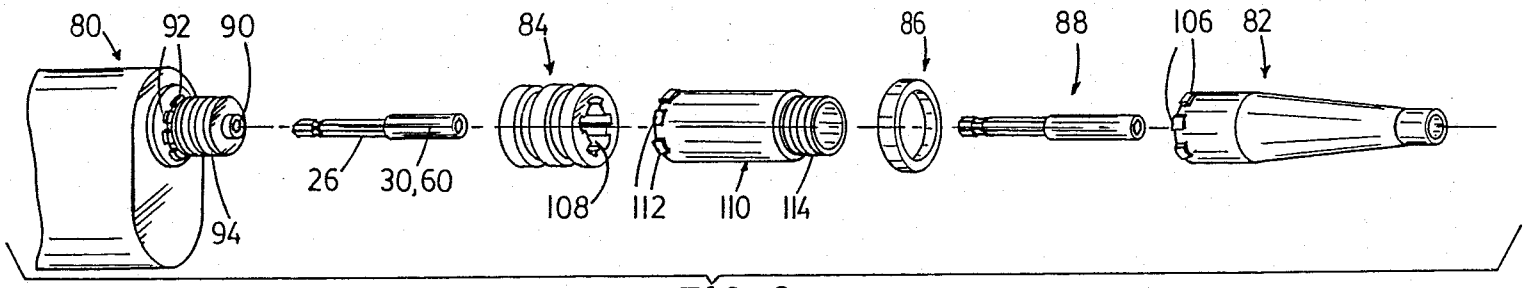

FIGS. 6, 7 and 8 show the structural elements and the assembly steps required for power screwdrivers of the MAKITA and RYOBI type (including some MILWAUKEE models). In these tools the depth adjustment is made at the tool itself and this must be accommodated in the extension pieces used.

FIGS. 6 and 7 show such a tool as it might be purchased, the tool including a power head 80, a nose piece 82, a depth adjustment sleeve 84, a snap ring 86 and a drive rod and magnetic bit holder 88. The power head 80 includes a built-in clutch 90, a plurality of radially projecting rectangular lobes 92, a threaded portion 94 and a circumferential snap ring (not shown). The drive rod and magnetic bit holder 88 is similar to the drive rods 18 and 72 of the other types of tools, having a rod portion 96 for reception in the clutch 90 and a magnetic bit holder 98 for receiving the bit (not shown), the bit being as is shown as item 20 in FIG. 1.

Nose piece 82 has a tapered end 100 extending from a cylindrical portion 102 and has an internal bore along which the drive rod 88 extends. The cylindrical portion 102 has internal threads (not shown) for mating engagement with the threaded portion 94 of the power head 80. At its free end the cylindrical portion 102 has a plurality of radially extending generally rectangular lobes 106 similar to the lobes 92.

The adjustment sleeve 84 has internal splines 108 extending inwardly from each end, one set of splines being engageable with the lobes 92 and the other set of splines being engageable with the lobes 106. Of course, the splines 108 may extend the full length of the adjustment sleeve 84 for engagement with both sets of lobes 92, 106. The snap ring 86 snaps over the outer end of sleeve 84 to prevent its removal from the cylindrical portion 102 of the nose piece 82.

Depth adjustment with a tool of this type involves pulling the sleeve 84 outwardly, rotating the nose piece 82 on the threaded portion 94 and pushing the sleeve 84 back towards the power head 80 so that the internal splines therein engage the lobes 92 to prevent unwanted relative rotation during use of the tool.

FIG. 8 shows how a tool as described with respect to FIGS. 6 and 7 may be modified by an extension device of the present invention. For such a tool the user is provided with an extension drive rod 26 (as previously used) and a sleeve such as item 30 or 60 (as previously used). However, a new slightly revised adaptor 110 is required, the adaptor 110 having radially projecting rectangular lobes 112 substantially identical to lobes 106, the lobes 112 being engageable by the splines 108 in the sleeve 84. Otherwise, the adaptor 110 is the same as previous adaptors, having internal threads (not shown) at the lobed end and external threads 114 at the other end.

In order to assemble the extension device to a tool such as the one just described one must first of all pull the adjustment sleeve 84 away from the lobes 92 and remove the nose piece 82 by threading it away from portion 94. The drive rod and bit holder 88 is removed from the chuck 90 and replaced by an extension rod 26 and sleeve 30, 60 assembly. The snap ring 86 is separated from the adjustment sleeve 84 so that the sleeve 84 can be removed from the nose piece 82 and then the sleeve 84 and snap ring 86 are reassembled over the adaptor 110 with the lobes 112 engaging the splines 108. The adaptor 110 with sleeve 84 attached is then threaded on to the power head 80 so that the adjacent splines on the sleeve 84 can engage the lobes 92 on the power head. The drive rod and bit holder 88 is inserted into the adaptor 110 so that the drive rod portion 96 thereof engages the sleeve 30, 60 and then the nose piece 82 is threaded on to the threaded end 114 of the adaptor 110 to complete the assembly.

By using a lobed adaptor 110 one can extend a tool having the depth adjustment at the power head without destroying the ability to drive screws to different depths. If a greater extension that is provided by the single assembly shown in FIG. 8 is required one need only add the necessary extension rods and sleeves and the necessary adaptors to the extension rod and sleeve and the adaptor initially assembled as described hereinabove.

Finally, although it has been suggested herein that the ideal extension length per assembly is about four inches it must be stressed that the length of each set of components is not restricted to the ideal length. For example one could machine adaptors, such as item 34, from lengths of tubular aluminum as desired and provide appropriately long extension rods 26 to mate with compatible sleeves 30, 60. Such an extension could be upwards of 12 inches in length although precautions would have to be taken to avoid whip in the extension rod per se. Clearly such a device would still embody the principles of the present invention.

In any event, it is clear that modifications could be made to the structure of the present invention without departing from the principles thereof and hence the protection to be afforded the invention is to be determined from the claims appended hereto.

The embodiments of the invention in which an exclusive property or privilege is claimed are defined as follows:

1. In an apparatus for driving screws into a receiving medium, the apparatus normally including power means, bit means, polygonal drive means removably connecting said power means to said bit means and depth gauge means threadedly connected to said power means, the improvement comprising an extension device for increasing the distance between the power means and the bit means, said device comprising:

first elongated polygonal extension rod means connectable to said power means in place of the polygonal extension drive means;

first elongated cylindrical sleeve means having a polygonal bore therein for receiving said first extension rod means in a press fit at one end thereof and for receiving the polygonal drive means in a press fit at the other end thereof, said drive means carrying said bit means; and first adaptor means for receiving said first sleeve means therein, said first adaptor means having threaded sections at each end thereof, one of said sections threadedly connecting said first adaptor means to said power means in place of said depth gauge means, and the other of said sections threadedly receiving the depth gauge means thereon.

2. The improvement of claim 1 comprising second rod means, second sleeve means and second adaptor means, wherein one end of said second rod means is receivable in the other end of said first sleeve means in place of said polygonal drive means, one end of said second sleeve means is receivable on the other end of said second rod means, said polygonal drive means carrying said bit means is receivable in the other end of said second sleeve means, and the one threaded section of said second adaptor means is threadedly connectable to the other threaded section of said first adaptor means in place of said depth gauge means, said depth gauge means being threadedly connectable to the other threaded section of said second adaptor means.

3. The improvement of claim 1 wherein said first rod means and sleeve means are integrally formed together, with said rod means projecting from one end of said sleeve means and said sleeve means having a polygonal blind bore at the other end thereof.

4. The improvement of claim 1 wherein said first sleeve means has a polygonal blind bore extending inwardly from each end thereof, terminating at a central transverse wall, and said first rod means is received in a press fit within one of said bores.

5. The improvement of claim 2 wherein each of said first and second sleeve means has a polygonal blind bore extending inwardly from each end thereof, terminating at a central transverse wall thereof, said first rod means being received in a press fit within one of said first sleeve means blind bores and said second rod means being received within one of said second sleeve means blind bores.

6. The improvement of claim 4 including a plurality of narrow elongated ribs on the polygonal surfaces of each of said blind bores and extending outwardly from the central wall of said first sleeve means.

7. The improvement of claim 5 including a plurality of narrow elongated ribs on the polygonal surfaces of each of said blind bores and extending outwardly from the central wall of each of said sleeve means.

8. The improvement of claim 2 wherein each of said adaptor means includes a large diameter bore therein and a transverse wall adjacent said one threaded section, said transverse wall having a smaller diameter central aperture therethrough adapted to pass one of sleeve means therethrough.

9. The improvement of claim 2 wherein each of said extension rod means, the drive means and each of said sleeve bores has a hexagonal cross-section.

10. In an apparatus for driving screws into a receiving medium, the apparatus normally including power means, bit means, polygonal drive means removably connecting said power means to said bit means, a nose piece threadedly connected to said power means and adjustment sleeve means for rotatably locking said nose piece relative to said power head, the improvement comprising an extension device for increasing the distance between the power means and the bit means, said device comprising:

first elongated polygonal extension rod means connectable to said power means in place of the polygonal extension drive means;

first elongated cylindrical sleeve means having a polygonal bore therein for receiving said first extension rod means in a press fit at one end thereof and for receiving the polygonal drive means in a press fit at the other end thereof, said drive means carrying said bit means; and first adaptor means for receiving said first sleeve means therein, said first adaptor means having threaded sections at each end thereof, one of said sections for threadedly connecting said first adaptor means to said power means in place of said nose piece, the other of said sections for threadedly receiving the nose piece thereon, and said first adaptor means also including means for engagement with the adjustment sleeve means of said apparatus.

11. The improvement of claim 10 wherein each of said power means and said nose piece includes a plurality of locking lugs thereon and said adjustment sleeve means is slidably engageable with said lugs, and wherein the engagement means of said first adaptor means includes a plurality of locking lugs identical to the locking lugs of said nose piece.

12. The improvement of claim 11 comprising second rod means, second sleeve means and second adaptor means, wherein one end of said second rod means is receivable in the other end of said first sleeve means in place of said polygonal drive means, one end of said second sleeve means is receivable on the other end of said second rod means, said polygonal drive means carrying said bit means is receivable in the other end of said second sleeve means, and the one threaded section of said second adaptor means is threadedly connectable to the other threaded section of said first adaptor means in place of said nose piece, said nose piece being threadedly connectable to the other threaded section of said second adaptor means.

* * * * *